US012037897B2

(12) United States Patent
Javed et al.

(10) Patent No.: US 12,037,897 B2
(45) Date of Patent: Jul. 16, 2024

(54) SMART ELINE OUTER DIAMETER METER RING

(71) Applicant: SAUDI ARABIAN OIL COMPANY, Dhahran (SA)

(72) Inventors: Muhammad Imran Javed, Abqaiq (SA); Ayedh M. Shehri, Dammam (SA); Sanjiv Kumar, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 65 days.

(21) Appl. No.: 17/931,481

(22) Filed: Sep. 12, 2022

(65) Prior Publication Data

US 2024/0084696 A1 Mar. 14, 2024

(51) Int. Cl.

| | |
|---|---|
| ***E21B 47/12*** | (2012.01) |
| ***E21B 17/00*** | (2006.01) |
| ***E21B 23/14*** | (2006.01) |

(52) U.S. Cl.
CPC ..... *E21B 47/12* (2013.01); *E21B 17/003* (2013.01); *E21B 23/14* (2013.01)

(58) Field of Classification Search
CPC ..... E21B 47/12; E21B 17/003; E21B 23/14
See application file for complete search history.

(56) References Cited

U.S. PATENT DOCUMENTS

2013/0141100 A1* 6/2013 Labib ..... G01N 27/82 324/333
2019/0032469 A1* 1/2019 Chatelet ..... E21B 33/08
2019/0136685 A1* 5/2019 Adetola ..... E21B 47/092
2019/0346340 A1 11/2019 Martin et al.
2021/0382007 A1 12/2021 Zheng et al.

FOREIGN PATENT DOCUMENTS

| | | | |
|---|---|---|---|
| CN | 106841379 | A | 6/2017 |
| CN | 114660166 | A | 6/2022 |
| WO | 2012/009286 | A1 | 1/2012 |
| WO | 2016/116454 | A1 | 7/2016 |

OTHER PUBLICATIONS

International Search Report and Written Opinion issued in corresponding International Application No. PCT/US2023/032398, dated Dec. 4, 2023 (13 pages).

* cited by examiner

*Primary Examiner* — Crystal J Lee
(74) *Attorney, Agent, or Firm* — Osha Bergman Watanabe & Burton LLP

(57) ABSTRACT

A wireline operation method is disclosed. The method includes disposing an outer diameter (OD) meter ring on a wireline, the OD meter ring having spring-loaded sensors, releasing, from a spooling drum into the wellbore, the wireline via a wireline passage having a tight spot, a released portion of the wireline progressively passing through an opening of the OD meter ring, generating, using the spring-loaded sensors, a real time OD measurement of a current location of the wireline passing through the opening of the OD meter ring at the time of measurement, generating, in response to the real time OD measurement of a particular location of the wireline exceeding a pre-determined threshold, a fail-safe signal, and stopping, in response to the fail-safe signal, the spooling drum from continuing to release the wireline before the particular location of the wireline reaches the tight spot of the wireline passage.

7 Claims, 6 Drawing Sheets

SMART ELINE OUTER DIAMETER METER RING

BACKGROUND

An armored cable is an insulated electrical cable having metal (e.g., steel, aluminum, etc.) wires that are wrapped or wound around the insulation of the electrical cable. The metal wires form a mechanical protection layer referred to as the armor or cable armor. Borehole logging is a process where specialized instrumentation (referred to as the logging tool) is inserted into a borehole to determine the properties of the geological formations surrounding the borehole. Borehole logging may be performed by suspending the logging tool under a cable (referred to as a wireline) to be lowered into the wellbore. The wireline may be a slickline or an eLine. In particular, the eLine is an electric cable, such as an armored cable, that transmits data from the logging tool to the Earth surface.

Breakage of the armors while performing eLine logging and other operations related to the eLine or wireline has been increasing in the oil and gas fields. The armor breakage may occur at a point of the eLine having an increase in the outer diameter (OD) thus rubbing against a tight spot in the passage into the wellbore. The OD increase may be due to foreign particles embedded into the cable armor. A broken/loose strand of the armor from the breakage may cause a tool stuck situation. For example, the broken armor may stick where the eLine pass through the grease injection head at top of the eLine lubricator. The broken armor may also stick within other Pressure Control Equipment (PCE) where the area of flow path is almost identical to the OD of eLine, e.g., with fraction of a millimeter difference such that any small change in OD of eLine will cause stuck situation of wireline and tool.

Once the tool is stuck, the only option to rectify this problem is to secure the well with at least two barriers and break out the lubricator while exposing the eLine passing through the Blow Out Preventer (BOP) and the X-Mas tree valves. Upon exposing the eLine, there is a long procedure to cut the cable and make up new connection through slicing procedures which is time consuming, extremely risky and could lead to many days to retrieve the entire cable and tool string (BHA) from the wellbore. Operators have to undertake multiple steps of breaking and re-connecting the lubricator on top of the BOP unless or until all wireline and BHA are retrieved.

SUMMARY

In general, in one aspect, the invention relates to a method to perform a wireline operation of a wellbore in a subterranean. The method includes disposing an outer diameter (OD) meter ring on a wireline, wherein the OD meter ring comprises a plurality of spring-loaded sensors, releasing, during the wireline operation and from a spooling drum into the wellbore, the wireline via a wireline passage comprising a tight spot, wherein a released portion of the wireline progressively passes through an opening of the OD meter ring, generating, using the plurality of spring-loaded sensors, a real time OD measurement of a current location of the wireline passing through the opening of the OD meter ring at the time of measurement, generating, in response to the real time OD measurement of a particular location of the wireline exceeding a pre-determined threshold, a fail-safe signal, and stopping, in response to the fail-safe signal, the spooling drum from continuing to release the wireline before the particular location of the wireline reaches the tight spot of the wireline passage.

In general, in one aspect, the invention relates to an outer diameter (OD) meter ring to facilitate a wireline operation of a wellbore in a subterranean formation. The OD meter ring includes a circular band comprising a first circumference, a second circumference, and an opening, and a plurality of spring-loaded sensors disposed on an inner surface of the circular band facing the opening, each of the plurality of spring-loaded sensors being connected to the first circumference and the second circumference via a first spring and a second spring, respectively, wherein the circular band is configured to allow a wireline progressively passing through the opening during the wireline operation, wherein the plurality of spring-loaded sensors are configured to contact an outer surface of the wireline passing through the opening and generate a plurality of sensor signals during the wireline operation, wherein the plurality of sensor signals is used to generate a real time OD measurement of a current location of the wireline passing through the opening at the time of measurement, and wherein a fail-safe signal is generated in response to the real time OD measurement of a particular location of the wireline exceeding a pre-determined threshold.

In general, in one aspect, the invention relates to a wireline truck to facilitate a wireline operation of a wellbore in a subterranean formation. The wireline truck includes a spooling drum configured to release a wireline into the wellbore through a wireline passage, and an outer diameter (OD) meter ring connected to the spooling drum and comprising a circular band comprising a first circumference, a second circumference, and an opening, and a plurality of spring-loaded sensors disposed on an inner surface of the circular band facing the opening, each of the plurality of spring loaded sensors being connected to the first circumference and the second circumference via a first spring and a second spring, respectively, wherein the circular band is configured to allow a wireline progressively passing through the opening during the wireline operation, wherein the plurality of spring-loaded sensors are configured to contact an outer surface of the wireline passing through the opening and generate a plurality of sensor signals during the wireline operation, wherein the plurality of sensor signals are used to generate a real time OD measurement of a current location of the wireline passing through the opening at the time of measurement, and wherein a fail-safe signal is generated in response to the real time OD measurement of a particular location of the wireline exceeding a pre-determined threshold.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein include a method and device to facilitate a wireline operation of a wellbore in a subterranean formation. In one or more embodiments of the invention, the device is an outer diameter (OD) meter ring that includes a circular band having a first circumference, a second circumference, and an opening where a set of spring-loaded sensors are disposed on an inner surface of the circular band facing the opening. Each spring-loaded sensor is connected to the first circumference and the second circumference via a first spring and a second spring, respectively. During the wireline operation, the circular band is configured to allow a wireline progressively passing through the opening such that the spring-loaded sensors contact an outer surface of the passing wireline to generate sensor signals. The sensor signals are used to generate a real time OD measurement of a current location of the wireline passing through the opening at the time of measurement. A fail-safe signal is then generated in response to the real time OD measurement of a particular location of the wireline exceeding a pre-determined threshold. A spooling drum is in turn stopped in response to the fail-safe signal to prevent the particular location of the wireline reaching a tight spot in the wireline passage of the wireline operation.

Figure 1:
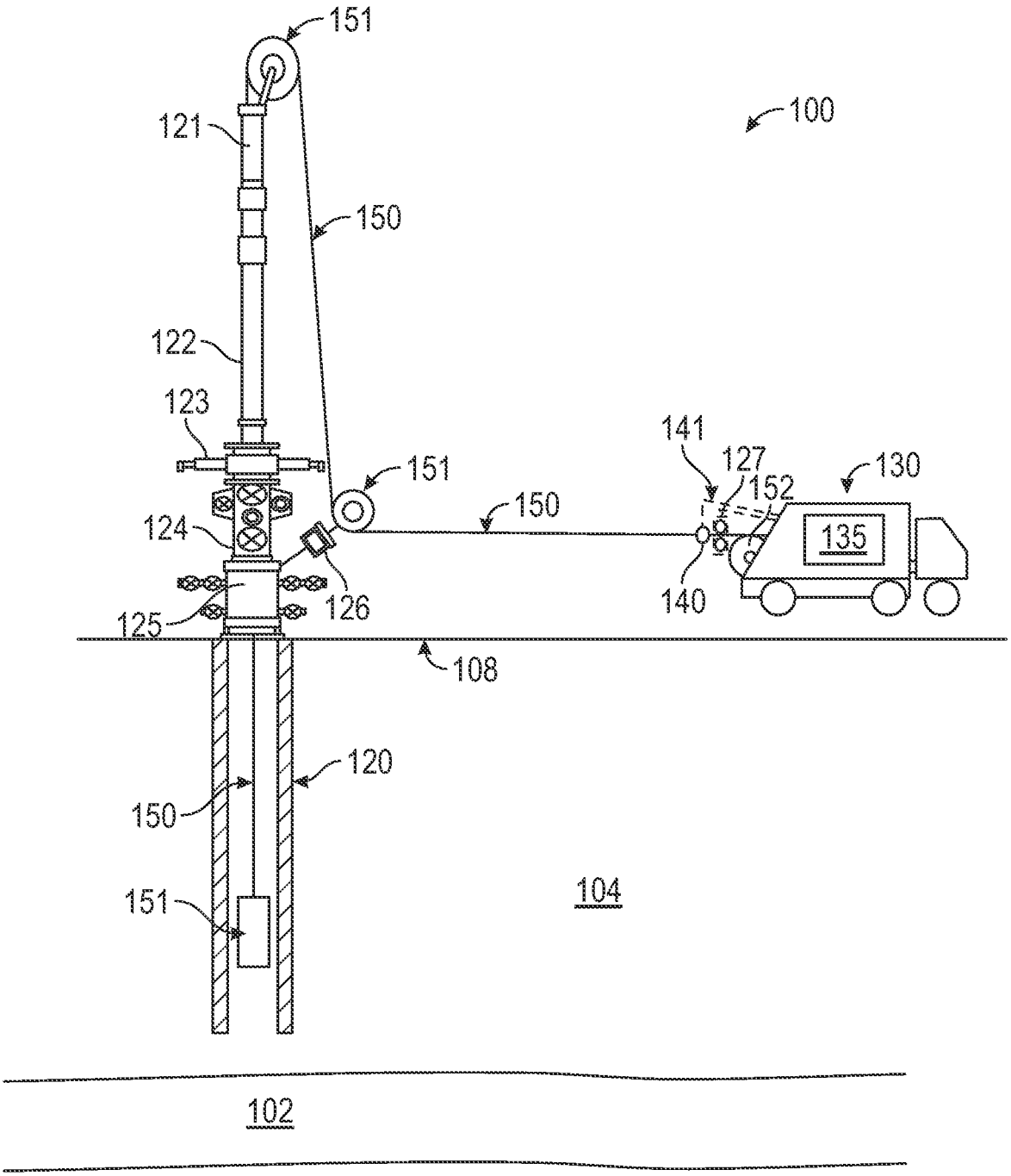
FIG. 1 shows a well system in accordance with one or more embodiments.

FIG. 1 shows a schematic diagram of a well system in accordance with one or more embodiments. In one or more embodiments, one or more of the modules and/or elements shown in FIG. 1 may be omitted, repeated, and/or substituted. Accordingly, embodiments disclosed herein should not be considered limited to the specific arrangements of modules and/or elements shown in FIG. 1.

As shown in FIG. 1, a well system (100) includes a subterranean formation ("formation") (104) penetrated by a wellbore (120) and having various equipment at the Earth surface (108). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. The formation (104) may include a hydrocarbon-bearing reservoir (102).

The wellbore (120) includes a bored hole (i.e., borehole) that extends from the surface (108) towards a target zone of the formation (104), such as the reservoir (102). The wellbore (120) may be drilled for exploration, development and production purposes. The wellbore (120) may be logged by lowering a combination of physical sensors downhole to acquire data that measures various rock and fluid properties, such as irradiation, density, electrical and acoustic properties. The acquired data may be organized in a log format and referred to as well logs or well log data. A well intervention, or well work, may be performed on the wellbore (120) during, or at the end of, its productive life that alters the state of the well or well geometry, provides well diagnostics, or manages the production of the well. Well intervention operations may include pumping, wellhead and Christmas (X-mas) tree maintenance, well workover, and wireline related intervention operations such as fishing, gauge cutting, setting or removing plugs, deploying or removing wireline retrievable valves, and well logging and perforating.

In some embodiments, a bottom hole assembly (BHA) (151) is attached to a wireline (150) to suspend into the wellbore (120). The wireline (150) may be an eLine or a slickline for performing a borehole logging operation, in which case the BHA (151) includes the logging tool. Downhole sensors are provided in the logging tool to measure downhole conditions. The sensor measurements may include temperature data, pressure data, in-situ cuttings evaluation data, etc.

In some embodiments, the equipment at the surface (108) includes a wireline truck (130) to store and deploy the wireline (150) into the wellbore (120). The wireline truck (130) may also be referred to as a logging truck. In particular, the wireline (150) is released from a spooling drum (152) (also referred to as a winch) to pass through a wireline passage including a depth counter (127), an outer diameter (OD) meter ring (140), sheaths (151), pressure control equipment (121), lubricator (122), blow out preventer (123), X-mas tree (124), and wellhead (125) before entering the wellbore (120). The depth counter (127) measures the cumulative length of the wireline (150) released from the spooling drum (152) and transmits the measured length to a computer system (135) of the wireline truck (130). The measured length corresponds to a depth of the BHA (151) in the wellbore (120). The OD meter ring (140) is a ring-shaped device that measures the OD of the wireline (150) in real-time as the wireline (150) passes through the interior opening of the ring shape while being released from the spooling drum (152).

For example, the OD meter ring (140) may be installed at a fixed position relative to the spooling drum (152) such that the entire length of released portion of the wireline (150) progressively passes through the OD meter ring (140) as the wireline (150) is released from the spooling drum (152). In one or more embodiments, the OD meter ring (140) is provided with sensors and data transmitter and receiver and is referred to as a SMART OD meter ring. In the context where the SMART OD meter ring is installed onto an eLine cable, the OD meter ring (140) is referred to as a SMART eLine OD meter ring. The measured OD of the wireline (150) is transmitted to the computer system (135) and correlated by the computer system (135) to the measured length of the wireline (150). The measured OD and measured length of the wireline (150) may be transmitted from the OD meter ring (140) and depth counter (127) to the computer system (135) using wired and/or wireless data communication means. The OD meter ring (140) may be lubricated from time to time using a lubricant supply line (141) from the wireline truck (130).

The OD of the wireline (150) is a very critical part of wellsite cable management. For example, eLine cables have to pass through surface pressure control equipment (121) as part of a well intervention operation to enter into a harsh environment in the wellbore (120). Any change in the OD of these cables can cause significant challenges to well intervention and lead to a well control problem situation. Most of the times, any fraction of a change in the cable OD results the stuck situation at the grease injection head situated on top of the lubricator (122). This further leads to a breakage of armor of the stranded cable and a complete stuck of the wireline (150) and the down hole tool string (BHA).

Embodiments disclosed herein provide a mechanism to record the OD of the eLine in real time and immediately activate safety protocols to stop the winch (or other fail-safe device) to expose the damaged portion of the eLine before the damaged portion enters into the grease injection head to cause any tool string (BHA) stuck situation.

For this purpose, the OD meter ring (140) is installed in the well system (100) to provide extreme safety feature for cable management. In this context, the well system (100) is also referred to as a wellsite cable management system where the OD meter ring (140) is installed either before or after (i.e., upstream or downstream to) the depth counter (127) to monitor the actual OD measurement (e.g., 0.038 inch) of the wireline (150) in real time. The spooling drum (152) automatically stops releasing any more cable if any change in the actual OD measurement exceeds a pre-set threshold (e.g., 0.002 inch) Immediate and automatic stopping of the spooling drum (152) prevents a damaged part of the wireline (150) from entering into any tight spot of the wireline passage, e.g., the grease injector head. For example, the tight spot is any location in the wireline passage where the opening for passing through the wireline (150) has a dimension larger than the OD of the wireline (150) by less than the pre-set threshold (e.g., 0.002 inch). In one or more embodiments, the tolerance window may be almost 0 when the cable movement through flow tube is considered as "tight spot". For example, if the flow tube passage area has a clearance of 0.05" then the cable OD has to be 0.0048" in order to pass through it. Anything lower than this will be against the pressure control equipment and anything a more than 0.0049" could be a tight spot for cable to move (Tolerance window is 0.001").

This wellsite cable management system provides cost savings, mitigates well downtime, enhances operational efficiency and avoids exposing personnel to critical well control problem situation.

In some embodiments, the computer system (135) includes hardware and/or software with functionality for facilitating operations of the well system (100), such as borehole logging operations, well maintenance operations, well intervention operations, and reservoir monitoring, assessment and development operations. In particular, the computer system (135) facilities operations of the wellsite cable management system described above. In some embodiments, the computer system (135) may include a computing device that is similar to the computing device (400) described below with regard to FIG. 4 and the accompanying description.

Figure 2:
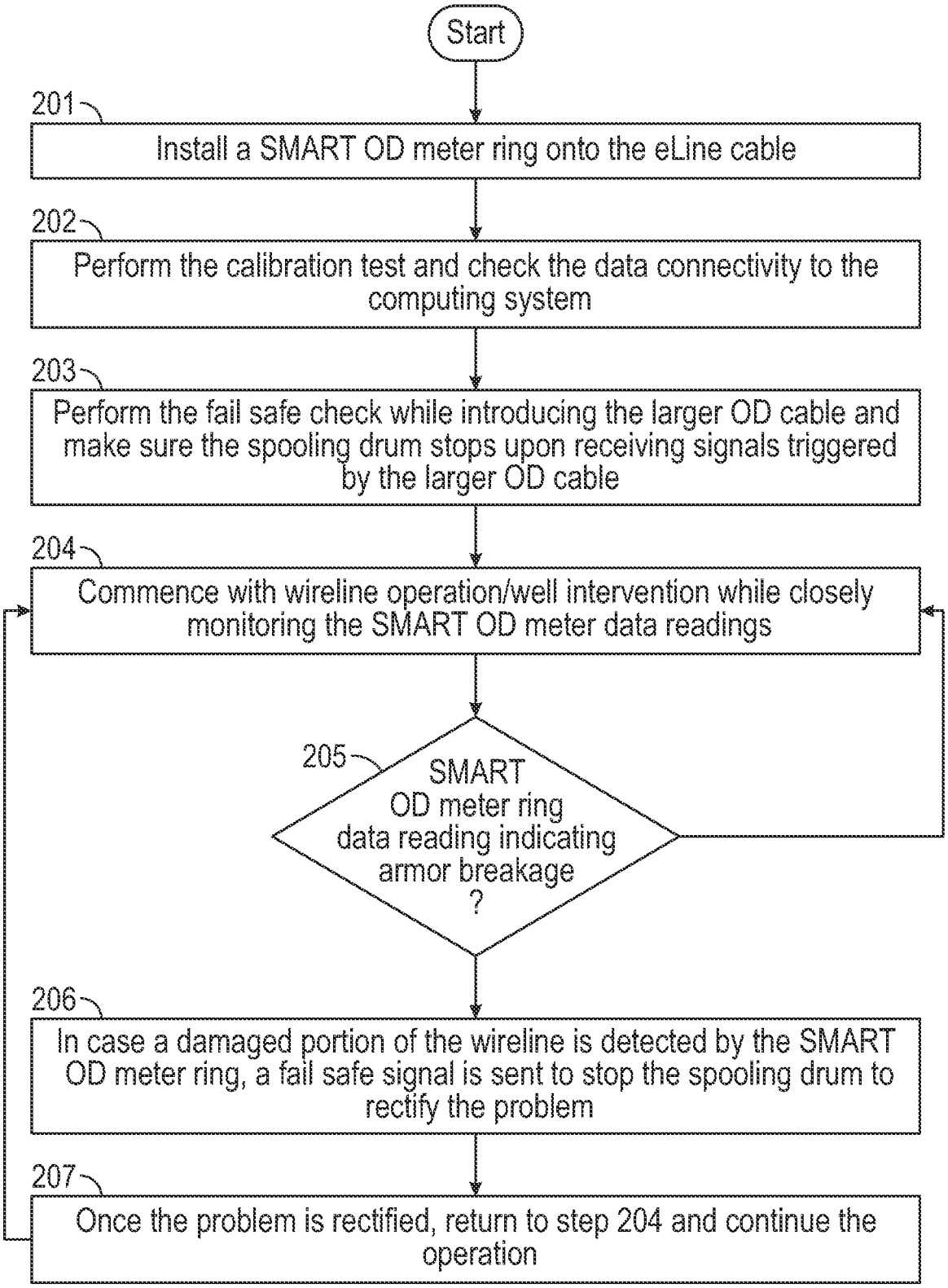
FIG. 2 shows a flowchart in accordance with one or more embodiments.

FIG. 2 shows a flowchart in accordance with one or more embodiments disclosed herein. One or more of the steps in FIG. 2 may be performed by the components of the well system (100), in particular the OD meter ring (140) and the computer system (135) discussed above in reference to FIG. 1. In one or more embodiments, one or more of the steps shown in FIG. 2 may be omitted, repeated, and/or performed in a different order than the order shown in FIG. 2. Accordingly, the scope of the disclosure should not be considered limited to the specific arrangement of steps shown in FIG. 2.

Referring to FIG. 2, initially in Step 201, an OD meter ring is installed onto a wireline. For example, a SMART OD meter ring is installed onto an eLine cable either before or after a depth counter in a wireline truck in a well system.

In Step 202, a calibration test is performed to check data connectivity between the SMART OD meter ring and a computer system of the wireline truck. For example, a calibration data packet may be transmitted by the SMART OD meter ring and verified by a central processing unit (CPU) of the computer system. Upon successfully completing the calibration test, the method proceeds to Step 203.

In Step 203, a fail-safe check is performed by introducing a test cable through the SMART OD meter ring to confirm that a fail-safe signal is received by the computer system from the SMART OD meter ring. The test cable has a larger OD than the normal wireline used in the wireline logging and/or intervention operation. The larger OD exceeds the pre-set threshold and triggers the SMART OD meter ring to send the fail-safe signal. Upon receiving the fail-safe signal, the computer system generates a control signal to immediately stop the spooling drum from releasing any more wireline cable. For example, the control signal may turn off the electrical power of the spooling drum or activate a breaking mechanism of the spooling drum. Upon successfully completing the fail-safe check, the method proceeds to Step 204.

In Step 204, the wireline logging operation/well intervention commences while the actual OD measurement of the wireline is monitored in real time by the SMART OD meter ring and the computer system. For example, one or more of pumping, wellhead and Christmas (X-mas) tree maintenance, well workover, and wireline related intervention operations such as fishing, gauge cutting, setting or removing plugs, deploying or removing wireline retrievable valves, and well logging and perforating may commence upon successfully completing the fail-safe check in Step 203 above.

In Step 205, a determination is made in real time as to whether any actual OD meter measurement exceeds the pre-set threshold and indicates that an armor breakage occurred. If the determination is positive, i.e., the actual OD meter measurement exceeds the pre-set threshold, the method proceeds to Step 206. If the determination is negative, i.e., the actual OD meter measurement did not exceed the pre-set threshold, the method returns to Step 204 to continue releasing the wireline for the operation.

In Step 206 in case a damaged portion due to stranded cable armor breakage is detected by the SMART OD meter ring, a fail-safe signal is sent from the SMART OD meter ring to the computer system of the wireline truck. For example, the fail-safe signal may be sent using a data transmitter of the SMART OD meter ring. In response, the computer system generates a control signal to immediately stop the spooling drum from releasing any more wireline cable so that the damaged wireline cable armor can be rectified.

In Step 207, once the damaged wireline cable armor is rectified, e.g., by repairing or replacing the damaged armor, the method returns to Step 204 to continue the wireline operations.

FIGS. 3A-3D show an example in accordance with one or more embodiments. In one or more embodiments, one or more of the modules and/or elements shown in FIGS. 3A, 3B and 3C may be omitted, repeated, and/or substituted.

Figure 3A:
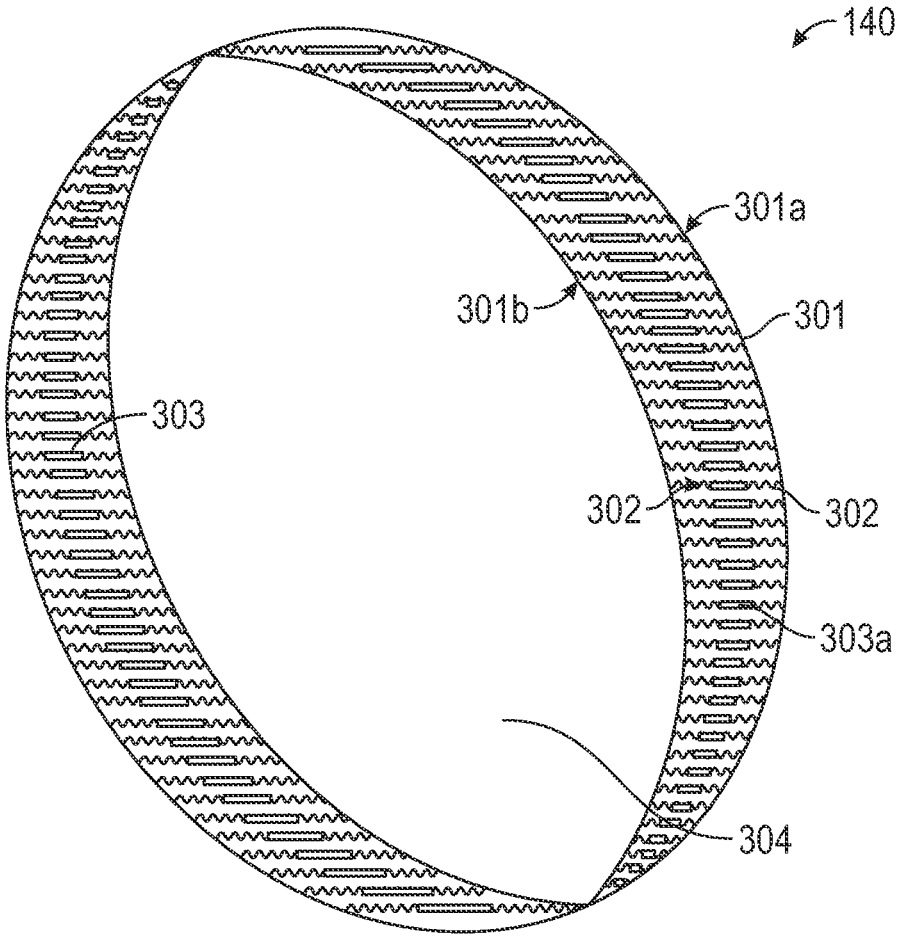
FIGS. 3A, 3B, 3C, and 3D show an example in accordance with one or more embodiments.
Figure 3B:
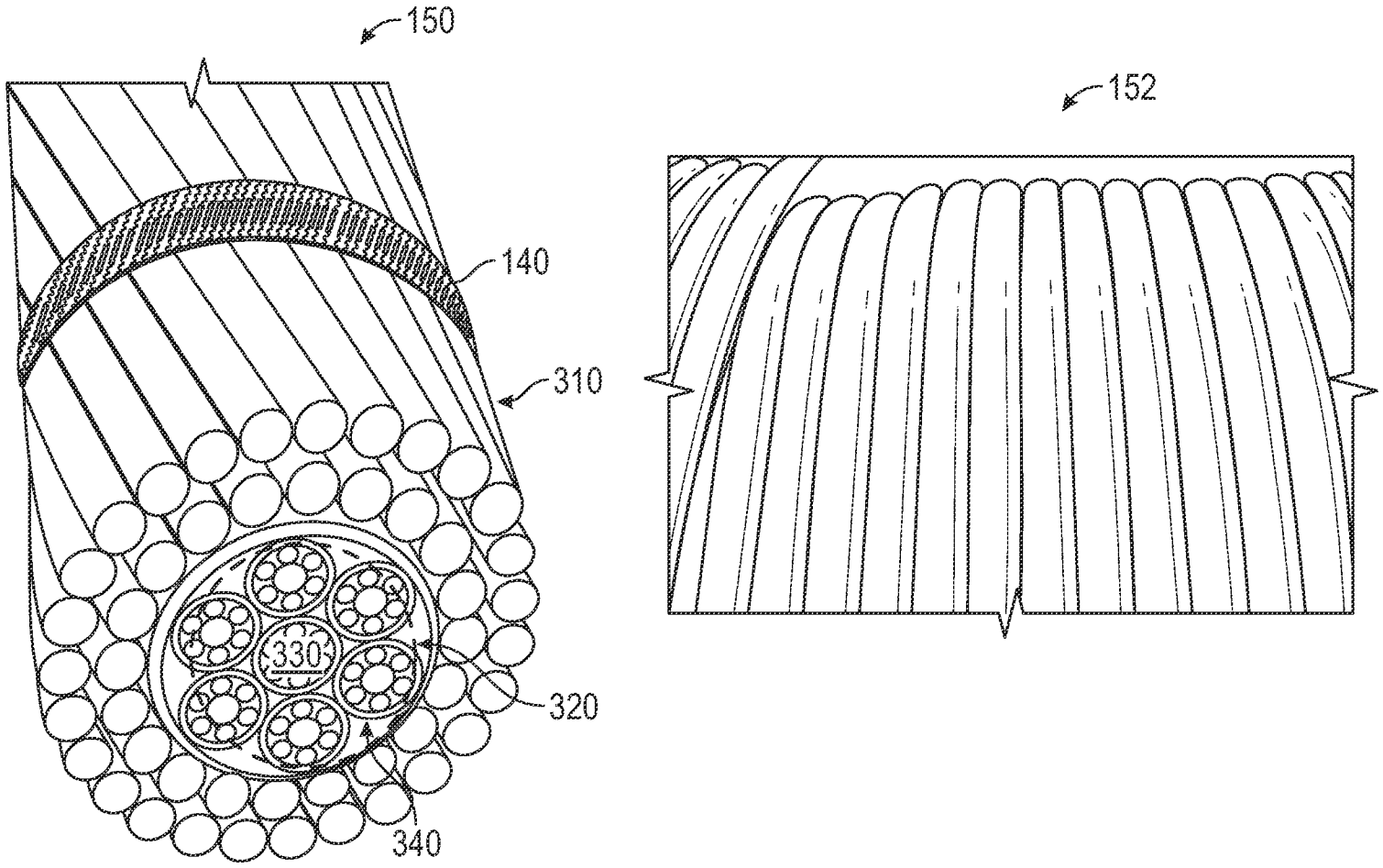
Figure 3C:
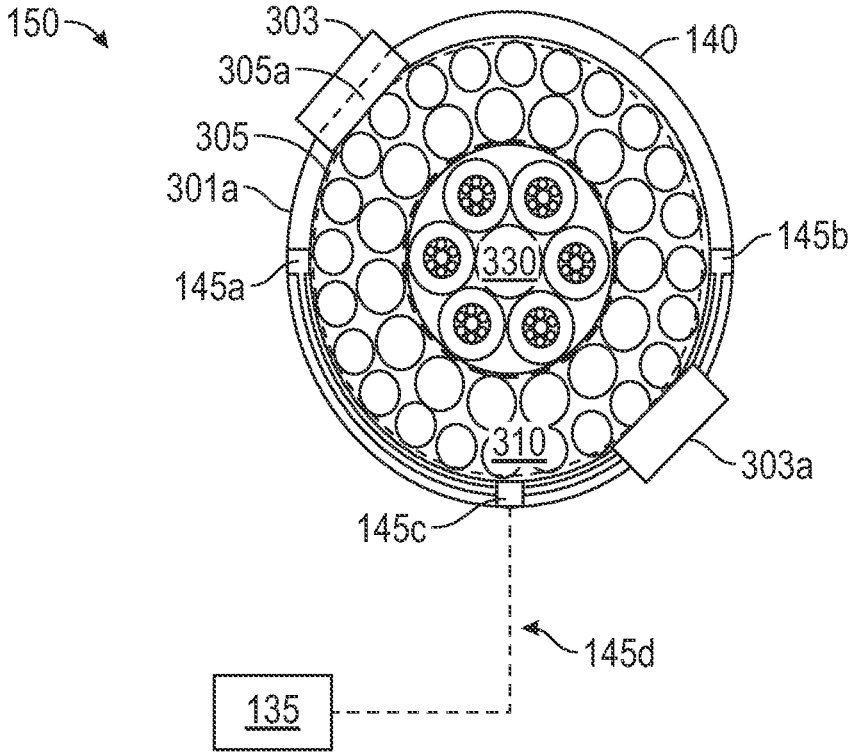

Accordingly, embodiments disclosed herein should not be considered limited to the specific arrangements of modules and/or elements shown in FIGS. 3A, 3B and 3C.

FIG. 3A shows an example OD meter ring (140), which may be the SMART eLine OD Meter Ring described above. As shown in FIG. 3A, the OD meter ring (140) includes a circular band (301) having a circumference A (301*a*) and a circumference B (301*b*) for connecting a set of spring-loaded sensors (e.g., sensor (303), (303*a*), etc.) on the circular band (301). Each of the circumference A (301*a*) and the circumference B (301*b*) is a rigid ring that collectively define the edges of the circular band (301). The spring-loaded sensors (e.g., sensor (303), (303*a*), etc.) are connected via springs (e.g., spring (302)) in-between the circumference A (301*a*) and the circumference B (301*b*). The set of spring-loaded sensors collectively form a ring of sensors surrounding an opening (304) of the circular band (301). The circumference A (301*a*) and the circumference B (301*b*) are rigidly connected together via one or more crossbars (not explicitly shown) to form the circular band (301). For example, a crossbar may be located between two adjacent sensors. Aside from the crossbars, the circumference A (301*a*) and the circumference B (301*b*) may be separated by empty space where the ring of sensors extends. In an alternative configuration, a sheet of elastic material may be stretched between the circumference A (301*a*) and the circumference B (301*b*) for the ring of sensors to adhere to. For example, the elastic sheet of material may substitute the springs to form each spring-loaded sensor. In other words, the springs depicted in FIG. 3A may be omitted in the configuration where the ring of sensors adhere to the elastic sheet of material stretched between the circumference A (301*a*) and the circumference B (301*b*).

As shown in FIG. 3A, sensor (303) and sensor (303*a*) are a pair of corresponding sensors disposed radially opposing each other. Two sensors are employed so that each sensor will cover 180 degrees, and both sensors also work as back up to each other. In one or more embodiments, each sensor generates a signal with an embedded signature for identification (ID). For example, each sensor signal may be a digital signal with an embedded ID code. In one or more embodiments, the sensor signal represents a distance between two opposing sensors of the sensor pair where the sensor belongs. For example, the sensor signal generated by the sensor (303) and the sensor (303*a*) each represents the distance between the sensor (303) and sensor (303*a*). The distance may be measured as a time delay of signal transmission exchanged between the sensor (303) and sensor (303*a*).

FIG. 3B shows example perspective views of the OD meter ring (140) installed onto the wireline (150) and the spooling drum (152) of the wireline (150). As shown in FIG. 3B, the eLine cable, also referred to as "wireline," is made of a conductor core (330) wrapped by an insulation layer (320) and together further wrapped by the armor (310). The insulation layer (320) provides electrical insulation between the conductor core (330) and the metallic armor (310). The conductor core (330) may be a multi-conductor core (e.g., 4 or 7 conductors) or a single conductor core. The conductor core (330) is used to transmit power to the downhole instrumentation and transmit data (commands) to and from the Earth surface. Single-conductor cables are similar in construction to multi-conductor cables but have only one conductor in the conductor core (330). The ODs of single-conductor cables are usually much smaller (e.g., from 1/10 inch to 5/16 inch) than multi-conductor cables (e.g., from 0.38 inch to 0.55 inch) and with suggested working loads of 800 to 7,735 pound-force (lbf). Different diameter OD meter ring is used to fit different diameter eLine cable such that the ring of spring-loaded sensors can touch the outer surface of the eLine cable. In other words, the OD meter rings are configured with different opening diameters to fit different ODs of eLine cable.

FIG. 3C shows a schematic diagram of an example cross-section of the OD meter ring (140) installed onto the wireline (150). As shown in FIG. 3C, the OD meter ring (140) encircles the armor (310) of the wireline (150), which is a multi-conductor cable having 7 conductors in the core (330). The OD meter ring (140) has a pair of transmitters (i.e., transmitter A (145*a*) and transmitter B (145*b*)) disposed opposite each other across the armor (310). The pair of transmitters transmits signals from the spring loaded sensors of the OD meter ring that are received by a transceiver (145*c*) of the OD meter ring. For example, the transmitter A (145*a*) and transmitter B (145*b*) may each receive sensor signals from a corresponding portion of the spring loaded sensors. In another example, the transmitter A (145*a*) and transmitter B (145*b*) may each receive sensor signals from all of the spring loaded sensors and provide backup redundancy to each other. The sensor signals are in turn sent to the computer system (135) from the transceiver (145*c*) via a data communication channel (145*d*). As noted above, the computer system (135) is located on the wireline truck (130) that analyzes the sensor signals from the OD meter ring (140) to determine the actual OD of the wireline (150) in real time as the wireline (150) passes through the OD meter ring (140). The data communication channel (145*d*) may be based on a wired or wireless communication media, such as electrical signal through physical wire, over the air radio frequency transmission, Bluetooth signal, etc.

Further as shown in FIG. 3C, each spring-loaded sensor (e.g., sensor (303), (303*a*), etc.) has a rigid body (represented as a solid rectangle) where part of the rigid body overlaps the opening (304) encircled by the circumference A (301*a*) and is referred to as an encroachment (e.g., encroachment (305*a*)). Only two spring-loaded sensor (i.e., sensor (303), (303*a*), etc.) are explicitly shown in FIG. 3C while other sensors are omitted for clarity. For the example where the nominal OD of the wireline (150) is 0.380 inch, the OD meter ring (140) is configured with a diameter of the opening (304) (i.e., inside diameter of the OD meter ring (140), also referred to as the opening diameter) equal to 0.390 inch, and the radial extent of the encroachment equals to 0.010 inch to define a reduced opening diameter of 0.380 inch. In other words, the inside boundaries of the rigid bodies of all spring-loaded sensors collectively define a circular contour (305) having a reduced opening diameter of 0.380 inch. When the OD meter ring (140) is installed onto the wireline (150) (e.g., an eLine cable), the reduced opening diameter of 0.380 inch allows the eLine cable with OD of the same 0.380 inch to pass through where the spring-loaded sensors (e.g., sensor (303), (303*a*), etc.) are in contact with the stranded cable armor (310) of the eLine. The spring-loaded sensors collectively record the actual OD of the eLine cable in real time. The measured distance of each sensor pair corresponds to the OD of the eLine for the corresponding angular direction if the eLine is not perfectly round in cross section.

When a damaged location of the eLine with a larger diameter (e.g., 0.382 inch) passes through the OD meter ring (140), each spring-loaded sensor (e.g., sensor (303), (303*a*), etc.) is pushed radially outwards by 0.001 inch and remains in contact with the stranded cable armor (310) due to the retention forces of the springs. The spring-loaded sensors (e.g., sensor (303), (303*a*), etc.) being pushed radially outwards reduces the extent of the encroachments. Accordingly, a larger OD measurement value is generated from the sensor signals.

The clearance gap between the rigid ring of the circumference A (301*a*) and the circular contour (305) defined by the rigid bodies of the spring-loaded sensors is 0.010 inch (i.e., difference between 0.390 in and 0.380 in), which allows any damaged portion of the eLine to physically pass through the OD meter ring (140) unimpeded as long as the OD of the damaged portion is less than 0.390 inch. However, any damaged portion having OD exceeding 0.382 inch will already trigger the fail-safe signal causing the spooling drum (152) to stop releasing the eLine. For the damaged portion having an irregular shaped cross section, the fail-safe signal is triggered when any of the sensor pairs generates an OD measurement that exceeds 0.382 inch.

Figure 3D:
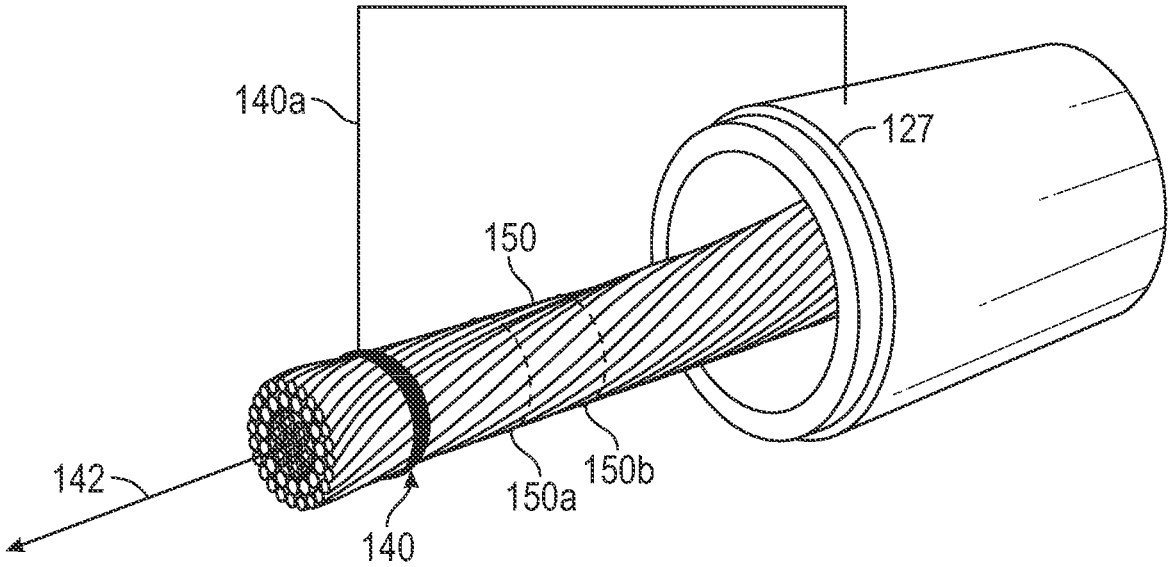

FIG. 3D shows an example perspective view of the wireline (150) passing through the depth counter (127) and the OD meter ring (140). As shown in FIG. 3D, the OD meter ring (140) is placed at a fixed position relative to the depth counter (127). For example, the OD meter ring (140) may be connected to the depth counter (127) via a mechanical arm (140*a*) to maintain the fixed position. Although not explicitly shown, the depth counter (127) is in turn mounted fixedly to the spooling drum (152). An electrical line may be routed along the fixed mounting of the depth counter (127) and the mechanical arm (140*a*) to supply electrical power from the wireline truck (130). The lubricant supply line (141) may be routed similarly as the electrical line. As the wireline (150) is released from the spooling drum (152) and moves along the downstream direction (142), the location of the wireline (150) at the center of the OD meter ring (140) at any time point is referred to as the current location. The time point corresponds to when the OD of the current location of wireline (150) is being measured using the OD meter ring (140), and is referred to as the time of measurement of the current location. The location A (150*a*) and location B (150*b*) of the wireline (150) pass through, one after another, the depth counter (127) and the OD meter ring (140). Accordingly, the time point when the location A (150*a*) is the current location corresponds to the time of measurement of the location A (150*a*). Subsequently, the time point when the location B (150*b*) is the current location corresponds to the time of measurement of the location B (150*b*). The location A (150*a*) is a normal location of the wireline (150) having a nominal OD and passes through the OD meter ring (140) without triggering any fail-safe signal. In contrast, the location B (150*b*) is a damaged location of the wireline (150) having a larger OD and therefore immediately triggers a fail-safe signal when passing through the OD meter ring (140). In one embodiment, the fail-safe signal is directly generated by and sent from the OD meter ring (140) to the computer system (135), which in turn activates a braking mechanism to stop the spooling drum (152) immediately. In an alternative embodiment, the fail-safe signal is generated by the computer system (135), based on sensor signals from the OD meter ring (140), that activates the braking mechanism to stop the spooling drum (152) immediately.

Figure 4:
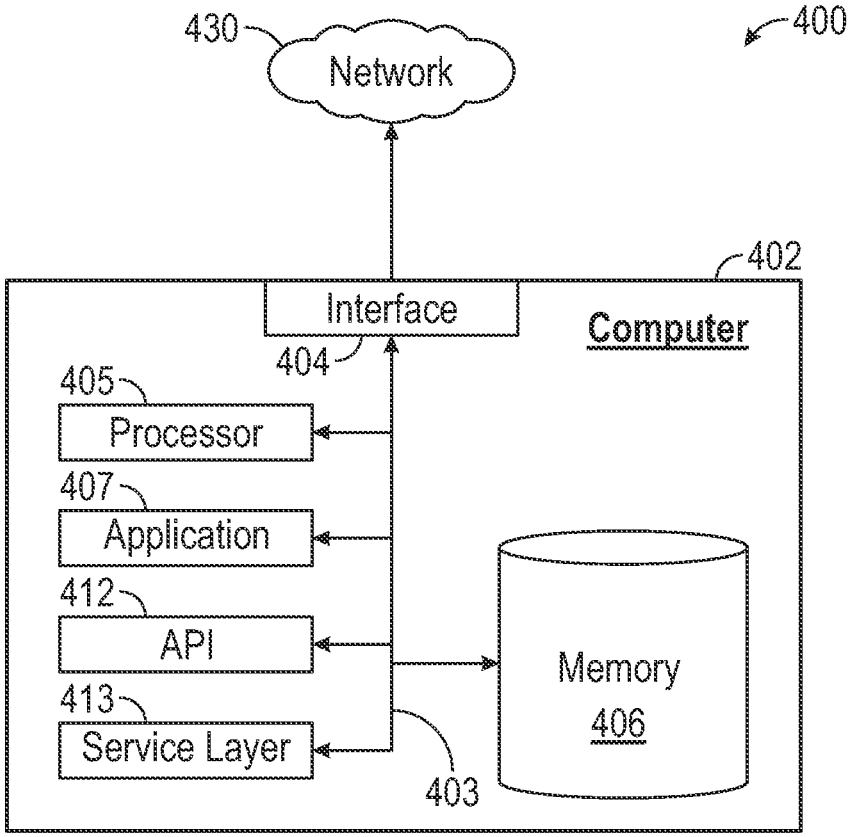
FIG. 4 shows a computing device in accordance with one or more embodiments.

Embodiments may be implemented on a computing device. For example, the in-situ sensing system (203) and data gathering and analysis system (160) may be implemented on a computer device. FIG. 4 depicts a block diagram of a computing device (400) including a computer (402) used to provide computational functionalities associated with described machine learning networks, algorithms, methods, functions, processes, flows, and procedures as described in this disclosure, according to one or more embodiments. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols, such as the Wellsite Information Transfer Specification (WITS) protocol, associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing a computer (402), wherein each computer (402) communicates over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

While the invention has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed:

1. A wireline truck to facilitate a wireline operation of a wellbore in a subterranean formation, comprising:

a spooling drum configured to release a wireline into the wellbore through a wireline passage; and an outer diameter (OD) meter ring connected to the spooling drum and comprising:

a circular band comprising a first circumference, a second circumference, and an opening; and a plurality of spring-loaded sensors disposed on an inner surface of the circular band facing the opening, each of the plurality of spring loaded sensors being connected to the first circumference and the second circumference via a first spring and a second spring, respectively, wherein the circular band is configured to allow a wireline progressively passing through the opening during the wireline operation, wherein the plurality of spring-loaded sensors are configured to contact an outer surface of the wireline passing through the opening and generate a plurality of sensor signals during the wireline operation, wherein the plurality of sensor signals are used to generate a real time OD measurement of a current location of the wireline passing through the opening at the time of measurement, and wherein a fail-safe signal is generated in response to the real time OD measurement of a particular location of the wireline exceeding a pre-determined threshold.

2. The wireline truck of claim 1, wherein the circular band is connected to the spooling drum via a mechanical arm to maintain a fixed relative position with respect to the spooling drum.

3. The wireline truck of claim 1, further comprising: a computer system, wherein the OD meter ring further comprises: at least one transceiver configured to transmit the plurality of sensor signals to the computer system, wherein the computer system is configured to: analyze the plurality of sensor signals to generate the real time OD measurement; compare the real time OD measurement and the pre-determined threshold to generate the fail-safe signal; and stop, in response to the fail-safe signal, the spooling drum from continuing to release the wireline during the wireline operation.

4. The wireline truck of claim 3, wherein the particular location of the wireline is prevented, based on stopping the spooling drum, from sticking in a tight spot of the wireline passage, wherein the tight spot corresponds to one or more of a piece of pressure control equipment and a grease injection head in the wireline passage.

5. The wireline truck of claim 1, wherein the wireline comprises a conductor core mechanically protected by a cable armor, and wherein the particular location corresponds to a damaged portion of the cable armor with an enlarged OD.

6. The wireline truck of claim 5, wherein the cable armor comprises twisted metallic wires structurally wrapping the conductor core, and wherein the damaged portion of the cable armor is caused by one or more of a foreign particle embedded in the twisted metallic wires, a broken strand of the twisted metallic wires, and a loose strand of the twisted metallic wires.

7. The wireline truck of claim 1, wherein the wireline comprises an eLine.

* * * * *